US005572307A

United States Patent [19]

Tomatsu et al.

[11] Patent Number: 5,572,307

[45] Date of Patent: Nov. 5, 1996

[54] PRESS MECHANISM USED WITH A FIXING DEVICE FOR AN IMAGE FORMING APPARATUS

[75] Inventors: Yoshiya Tomatsu, Kasugai; Takao Nakazawa, Owariasahi, both of Japan

[73] Assignee: Brother Kogyo Kabushiki Kaisha, Nagoya, Japan

[21] Appl. No.: 493,284

[22] Filed: Jun. 21, 1995

[30] Foreign Application Priority Data

Jul. 21, 1994 [JP] Japan ..... 6-190952

[51] Int. Cl.[6] ..... G03G 15/20

[52] U.S. Cl. ..... 399/122; 432/60; 399/331

[58] Field of Search ..... 355/290, 282, 355/285, 295; 219/216; 432/60

[56] References Cited

U.S. PATENT DOCUMENTS 4,341,458 7/1982 Glasa et al. .
4,464,985 8/1984 Asanuma et al. .
4,498,757 2/1985 Lance et al. ..... 219/216
5,359,181 10/1994 Waechtler et al. ..... 355/295

*Primary Examiner*—R. L. Moses
*Attorney, Agent, or Firm*—Oliff & Berridge

[57] ABSTRACT

A fixing device includes a heat roller, which is rotatably mounted to a frame, a press roller, which is rotatably mounted to the frame, and a press mechanism for pressing the press roller against the heat roller. The press mechanism has a displacement member that is displaceable in a press direction, a bearing portion that is movable in the opposite direction relative to the displacement member and supports the press roller at a shaft portion thereof, an urging member for urging the bearing portion in the press direction, and displacing structure for displacing the displacement member between a first position corresponding to a non-press position and a second position corresponding to a press position. The urging force of the urging member in the press direction is reinforced by action of the bearing portion, which is displaced in the opposite direction relative to the displacement member when the displacement member is displaced from the first position to the second position.

20 Claims, 6 Drawing Sheets

PRESS MECHANISM USED WITH A FIXING DEVICE FOR AN IMAGE FORMING APPARATUS

BACKGROUND OF THE INVENTION

1. Field of the Invention

The present invention relates to a fixing device for use in an image forming apparatus, and particularly to a fixing device that is compact and easy to manufacture.

2. Description of Related Art

An image forming apparatus for forming an image using an electrostatic recording system is provided with a fixing device 70 for fixing a toner image transferred onto a sheet. FIG. 8 shows a conventional fixing device 70, which is used in this type of image forming apparatus. As shown in FIG. 8, the fixing device 70 comprises a heat roller 71, a press roller 72 and a press mechanism 73 for pressing the press roller against the heat roller 71. In a fixing operation, the press roller 72 is pressed against the heat roller 71 under pressure by the pressure mechanism 73, and a sheet having a toner image thereon is passed through a gap between these rollers. The fixing device 70 is designed so that the press roller 72 is moved away from the heat roller 71 when a sheet jam occurs between the press roller 72 and the heat roller 71.

The conventional press mechanism 73 comprises an arm 74, a spring 75 and a cam 76. A rotational-shaft end portion 77 of the press roller 72 is rotatably supported by a bearing 78, which is formed at an intermediate portion of the arm 74. One end 79 of the arm 74 is rotatably mounted on a frame 80, and a spring 75 is suspended between the other end of the arm 74 and the frame 80 to press the press roller 72 against the heat roller 71 with urging the force of the spring 75. A cam 76 having a cam face, which comes into contact with the arm 74, is rotatably disposed in the vicinity of the end portion of the arm 74 at the spring side (hereinafter referred to as "spring-side end portion"). As shown in FIG. 9, when the cam 76 is rotated counterclockwise, the spring-side end portion of the arm 74 is moved against the urging force of the spring 75 in the opposite direction to the urging direction of the spring 75, that is, in a direction as indicated by an arrow of FIG. 9. With this motion, the press roller 72 is moved away from the heat roller 71.

However, since the conventional press mechanism 73 as described above is designed so that each of two arms 74 at both sides of the press roller 72 is disposed to extend to both the front and rear sides of the press roller 72, the whole length of the fixing device 70 in a sheet feeding direction is longer than the length of the press roller 71 in a radial direction, and this arrangement is an obstacle to miniaturization of the image forming apparatus. Furthermore, if a hold position of the spring 75 on the frame 80 or a securing position of the cam 76 varies, the degree of contact pressure of the press roller 72 to the heat roller 71 would also vary. Therefore, the spring 75 and the cam 76 must be secured to each other with high precision, and thus, a manufacturing process of the press mechanism is cumbersome.

SUMMARY OF THE INVENTION

An object of the present invention is to provide a fixing device that can be designed to be compact by miniaturizing a press mechanism and that is easy to manufacture, thereby meeting a requirement for miniaturization and construction of an image forming apparatus.

In order to attain the above object, according to the present invention, a fixing device is provided comprising a heat roller, which is rotatably mounted to a frame, a press roller, which is rotatably mounted to the frame, and a press mechanism for pressing the press roller against the heat roller. The press mechanism has a displacement member that is displaceable in a press direction, a bearing portion that is movable relative to the displacement member in the opposite direction to the displacement direction of the displacement member and supports the press roller at the shaft portion thereof, an urging member for urging the bearing portion in the press direction, and displacing structure for displacing the displacement member between a first position corresponding to a non-press position and a second position corresponding to a press position. The urging force of the urging member in the press direction is reinforced by action of the bearing portion, which is relatively displaced in the opposite direction to the displacement direction of the displacement member when the displacement member is displaced from the first position to the second position.

Therefore, when the displacing structure displaces the displacement member from the first position to the second position, the urging force of the urging member, which is interposed between the displacement member and the bearing portion of the press roller, is intensified, and the press roller is pressed against the heat roller by the intensified urging force. Furthermore, since the press mechanism is designed so that the bearing portion is moved relative to the displacement member in the opposite direction to the displacement direction of the displacement member, and the urging force of the urging member is intensified by the displacement of the displacement member to the second position as described above, the displacement member is not designed to extend to the front and rear sides of the press roller, enabling it to be miniaturized. Accordingly, the press mechanism can be designed in compact size, and an image forming apparatus in which the press mechanism is installed can also be designed in compact size.

In the fixing device as described above, the displacing structure is engaged with the displacement member, and it is secured to a reception portion, which is formed on the frame in a direction substantially perpendicular to the urging direction of the urging member. Therefore, the displacing structure is kept at a fixed position irrespective of the urging force, so that a stable operation can be achieved and its manufacture can be facilitated.

Furthermore, the displacing structure is rotatably mounted to the frame, and it has a cam face with which the displacement member is displaced from the first position to the second position through the rotation thereof. That is, the displacement member is displaced between the first position and the second position by the rotational operation of the displacing structure, so that an operational performance of releasing the press-contact of the press roller to the heat roller can be further improved, and the fabrication of the press mechanism can be facilitated.

Still further, the displacement member is supported at the shaft end portion of the press roller to be freely slidable in the press direction, and the displacing structure is disposed substantially on an extension line of the press direction of the press roller. Accordingly, the displacement member is displaced in the press direction by the displacing structure. This displacing motion of the displacement member intensifies the urging force of the urging member, which is interposed between the displacement member and the bearing portion of the press roller, and the press roller is pressed against the heat roller by the intensified urging force. In addition, the displacement member and the displacing structure are disposed in the press direction, so that the displacing structure is not disposed to extend to the front and rear sides of the press roller, and the press mechanism can be further miniaturized.

Still further, the urging member is interposed between the displacement member and the bearing portion, and the displacement member is supported at the shaft end portion of the press roller to be freely slidable in the press direction and has a stopper member for restricting a sliding motion of the displacement member in the press direction. Therefore, the displacement member, the urging member and the bearing portion can be mounted to the frame in a state where these members are assembled at the shaft end portion of the press roller; that is, these members can be mounted to the frame as a single unit, and the fixing device of the present invention is easy to manufacture.

BRIEF DESCRIPTION OF THE DRAWINGS

A preferred embodiment of the present invention will be described in detail with reference to the following figures wherein.

DETAILED DESCRIPTION OF PREFERRED EMBODIMENTS

A preferred embodiment according to the present invention will be described with reference to the accompanying drawings. In the following embodiment, the present invention is applied to a laser printer.

Figure 1:
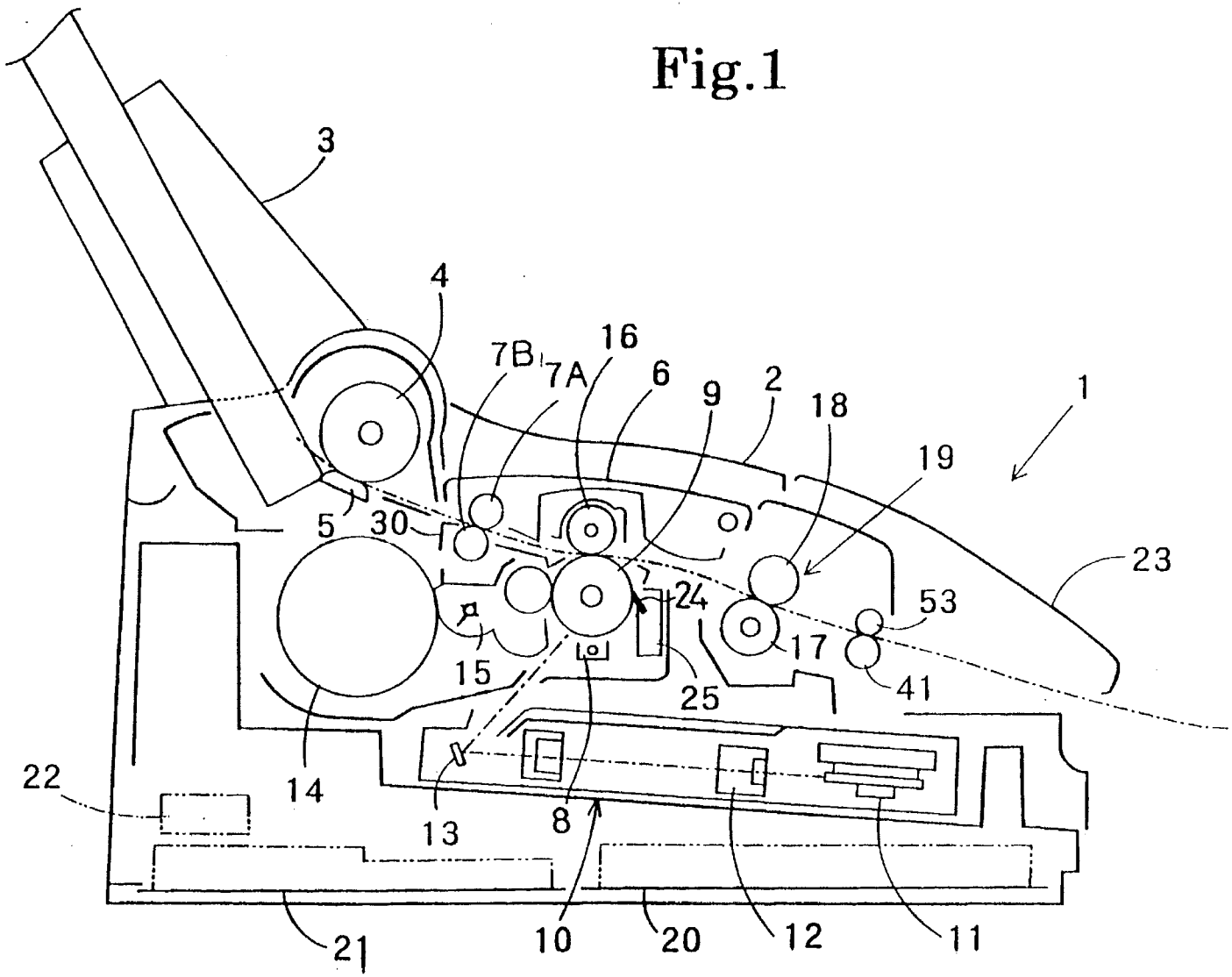
FIG. 1 is a longitudinal-sectional view showing a printer.

First, the construction of the laser printer will be described with reference to FIG. 1. In FIG. 1, a printer 1 has a body cover 2, which can be opened and closed. A sheet guide 6 whose inner side surface constitutes a part of a sheet path is provided at the inner side of the body cover 2. In order to correct equipment trouble, such as a paper jam or the like, the sheet guide 6 is designed so that it can be opened and closed when the cover 2 is open.

A sheet supply unit 3 is freely detachably mounted in the printer 1, and sheets that are laminated and stocked in the sheet supply unit 3 are separated and fed one by one using a known sheet supply roller 4 and a known separation pad 5. A sheet path through which a sheet fed out from the sheet supply unit 3 is guided to a photosensitive drum 9 is formed between the sheet guide 6 and a feeding chute 30, which is provided on the upper surface of a process unit as described later, and feeding rollers 7A, 7B are supported by the sheet guide 6 and the feeding chute 30, respectively.

The printer body is provided with an exposure unit 10 for exposing the surface of the photosensitive drum 9 to light in accordance with image data. The surface of the photosensitive drum 9 is uniformly charged in advance by a charger 8, and an electrostatic latent image is formed on the surface of the photosensitive drum 9 through the above exposure operation. The exposure unit 10 comprises a laser diode 11, a lens 12 and a reflection mirror 13. A toner box 14 is disposed at one side of the photosensitive drum 9, and a developing unit 15 is disposed between the toner box 14 and the photosensitive drum 9.

A transfer roller 16 is disposed in contact with the photosensitive drum 9 above the photosensitive drum 9. A sheet is guided in a gap between the photosensitive drum 9 and the transfer roller 16, and a toner image formed on the photosensitive drum 9 is transferred onto the sheet. A fixing unit 19 containing a heat roller 17 and a press roller 18 is disposed at the opposite side of the photosensitive drum 9 to the side at which the developing unit 15 is disposed, that is, at the downstream side of the photosensitive drum 9. In the fixing unit 19, the toner image transferred onto the sheet is melted and fixed onto the sheet. Between the transfer roller 16 and the fixing unit 19 is disposed a toner withdrawal box 25 having a cleaning blade 24 in contact with the photosensitive drum 9. In the toner withdrawal box 25, the cleaning blade 24 is brought into contact with the photosensitive drum 9 to scrape off residual toner on the photosensitive drum 9 that has passed through the transfer roller 16, and the scraped-off toner is withdrawn for reuse.

The printer 1 includes therein a fan (not shown) for discharging heat from the fixing unit 19 to the outside, and a motor (not shown) for rotating the photosensitive drum 9, the sheet supply roller 4, the feeding roller 7A and the heat roller 17. Control boards 20 and 21 and a power source unit 22 are disposed at the lower side of the exposure unit 10, and plural operation buttons and a display LED (not shown) are provided on a cover body 23 constituting a housing.

Of the various kinds of parts constituting the printer 1 shown in FIG. 1, the toner box 14, the developing unit 15, the photosensitive drum 9 and the transfer roller 16 are beforehand unified as a process unit, and the process unit thus fabricated is freely detachably installed in the printer 1. The toner box 14 can be also freely detachably mounted in the process unit.

Figure 2:
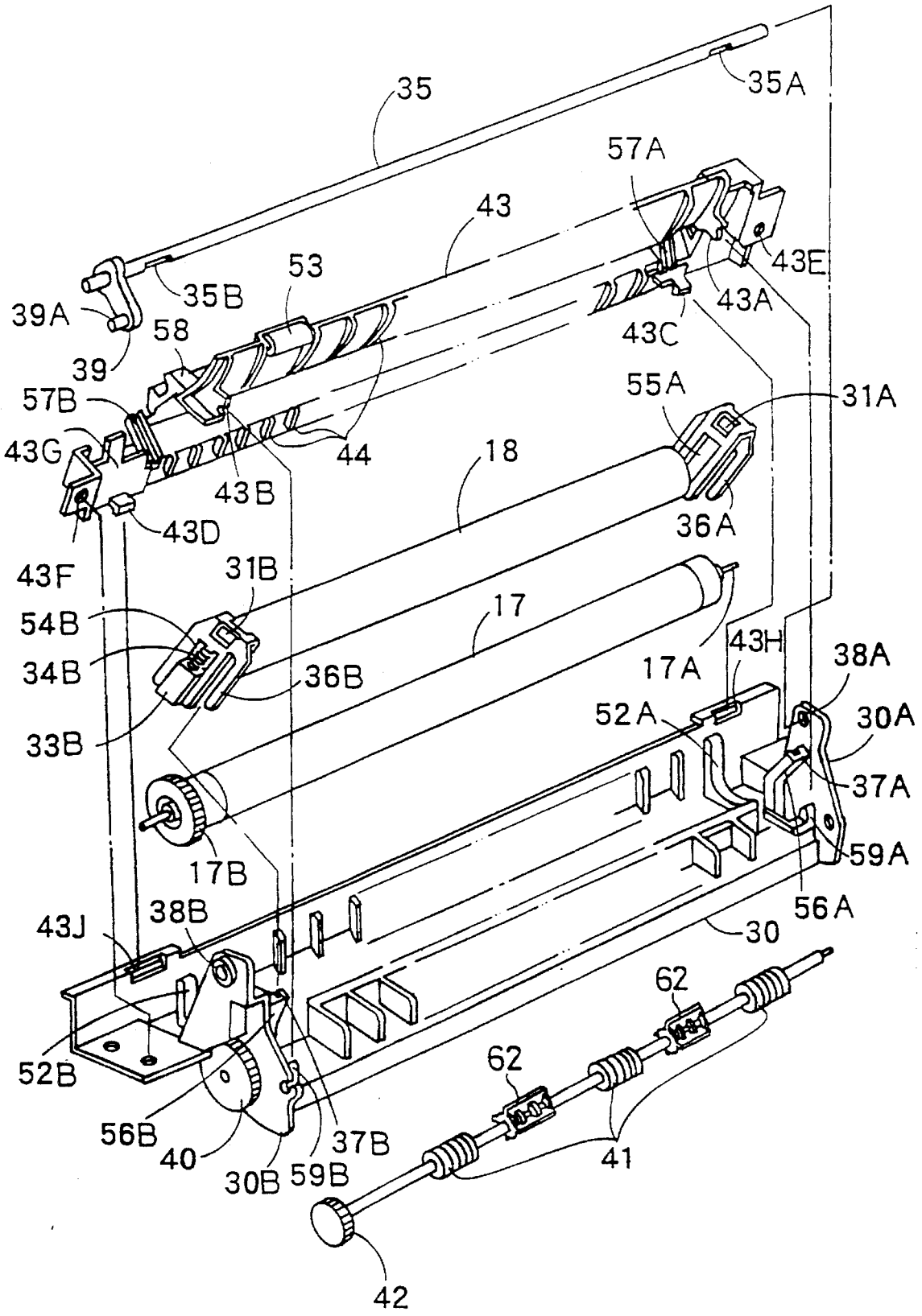
FIG. 2 is an exploded perspective view showing a fixing portion.

Next, the fixing unit 19 will be described in detail with reference to FIG. 2. FIG. 2 is an exploded perspective view showing the fixing unit 19.

Figure 6:
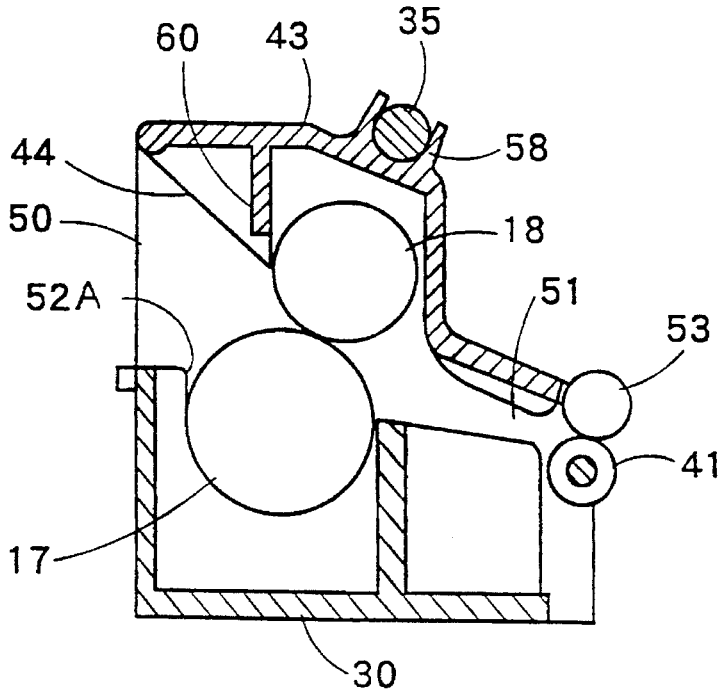
FIG. 6 is a cross-sectional view showing a central portion of the fixing portion.

The fixing unit 19 comprises the heat roller 17, the press roller 18, a press mechanism 32–35 for pressing the press roller 18 against the heat roller 17, a frame 30 for supporting the above elements and a fixing cover 43. The frame 30 and the fixing cover 43 are disposed at the upper and lower sides of the fixing unit 19, and a sheet insertion port 50 and a sheet discharge port (see FIG. 6) are formed at the front and rear sides between the frame 30 and the fixing cover 43, respectively. The heat roller 17 contains a halogen lamp 17A as a heat source therein, and the halogen lamp 17A is rotatably supported at both ends thereof by reception portions 52A, 52B having a semicircular shape in section, which are formed in the vicinity of the right and left ends of the frame 30. A gear 17B is fixed to one end portion of the heat roller 17 and engages an idle gear 40. The idle gear 40 is also engaged with a gear 42 that is provided on the same shaft as feeding rollers 41. The feeding rollers 41 are rotatably supported at predetermined intervals between side walls 30A, 30B, which are erected from both the right and left sides of the frame 30, and the rollers 41 are rotated through the rotation of the gear 42. The feeding rollers 41 discharge the fixed sheet to the outside of the apparatus in cooperation with a roller 53, which is supported by the fixing cover 43. The press roller 18 is formed of silicon rubber, and it has substantially the same axis length (longitudinal length) as the heat roller 17. The press roller 18 is moved by the press mechanism 32~35 to be pressed against the heat roller and separated from the heat roller while maintaining a parallel relationship with the axis of the heat roller 17.

The press mechanism 32~35 includes a displacement member (32A), 32B, a bearing portion (33A), 33B, an urging member such as a compression spring (34A), 34B, and a displacing device such as a cam shaft 35. The displacement member (32A), 32B is designed to have a dual structure in which a plate-shaped body, which is bent in a substantially inverted U-shaped form, and grooves (54A), 54B and 55A, 55B are formed at the inner wall portion of the displacement member (32A), 32B. A shaft end (18A), 18B of the press roller 18 is inserted in the grooves (54A), 54B and 55A, 55B to be slidable toward the heat roller 17. A bearing portion (33A), 33B is secured to the outer wall portion of the displacement member (32A), 32B. A rectangular through hole 31A, 31B is formed parallel to the axial line of the press roller 18 at the upper side of the displacement member (32A), 32B to penetrate through the outer wall portion of the displacement member (32A), 32B, and a guide piece 36A, 36B is projectingly formed on the displacement member (32A), 32B away from the outer wall portion at an interval.

The compression spring (34A), 34B is compressed into a gap between the bearing portion (33A), 33B and the upper end portion of the groove (54A), 54B, and it is held by pushing the bearing portion (33A), 33B against the shaft end (18A), 18B of the press roller 18. The press roller 18 is urged toward the heat roller 17 by the compression springs (34A), 34B.

The press mechanism 32~35 thus constructed is provided at each of both ends of the press roller 18 as shown in FIG. 2. Before the press roller 18 is installed into the fixing unit 19, the shaft end (18A), 18B abuts against a stopper member (55C), 55D at the lower end of the groove 55A, 55B by an urging force of the urging spring (34A), 34B, whereby the sliding motion of the bearing portion (33A), 33B in the urging direction is restricted, and it is maintained fixed to the shaft end (18A), 18B.

A rib-shaped wall 56A, 56B is formed on the inner and outer surfaces of each of both side walls 30A, 30B of the frame 30 to be elongated parallel to a direction extending to the center of the heat roller 17, and a groove 37A, 37B is formed on the wall 56A, 56B in the same direction as the rib-shaped wall 56A, 56B. The fixing cover 43 is provided with grooves 57A, 57B that are elongated parallel to the grooves 37A, 37B. Both side edges of the outer wall portions of the displacement members (32A), 32B are inserted into the grooves 37A, 37B, 57A, 57B, and the wall 56A, 56B is sandwiched between one of the side edges and the guide piece 36A, 36B. With this arrangement, the displacement member (32A), 32B is restricted in its movement in the axial direction of the heat roller 17, and it is slidably supported to approach the heat roller 17 and move away from the heat roller 17.

The cam shaft 35 serving as the displacing device is designed in a rod shape having a circular section, and both ends thereof are disposed so as to penetrate through the through holes 31A, 31B of the displacement members (32A), 32B. The cam shaft 35 is rotatably supported by bearing holes 38A, 38B, which are formed in a direction perpendicular to the urging direction at both side walls 30A, 30B of the frame 30. The cam shaft 35 is partially cut out on the peripheral portion thereof corresponding to the through holes 31A, 31B, thereby forming semicircular cam portions 35A, 35B. A release lever 39 is fixed to one end portion of the cam shaft 35, and a plurality of recessed receptors 58 having a semi-cylindrical shape for accommodating a middle portion of the cam shaft 35 are formed on the upper surface of the fixing cover 43.

Next, a construction method of the heat roller 17, the press roller 18 and the press mechanism 32~35 will be described.

First, the heat roller 17 is pivotally mounted on the heat roller receiving portions 52A, 52B, which are formed on the frame 30. At this time, the gear 17B, which is fixed to the one end portion of the rotational shaft of the heat roller 17 is engaged with the idle gear 40. Subsequently, an assembly, which is obtained by securing the displacement members (32A), 32B, the bearing portions (33A), 33B and the compression springs (34A), 34B to both the shaft ends of the press roller 18, respectively and unifying these members into one body (hereinafter referred to as "press roller unit 32~34"), is supported between the walls 56A, 56B of the frame 30. At this time, the displacement members (32A), 32B are freely slidably supported by the walls 56A, 56B as described above.

Thereafter, the fixing cover 43 is placed on the frame 30. This process will be described in more detail with reference to FIG. 5.

Figure 5:
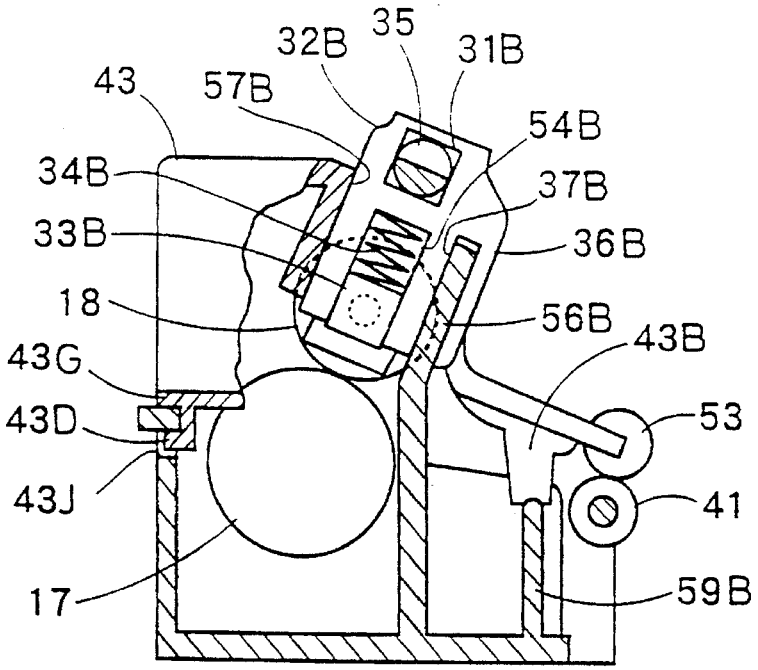
FIG. 5 is a cross-sectional view showing a portion near to a side end portion of the fixing portion.

As shown in FIG. 5, both right and left end portions 43G at the front side of the fixing cover 43 are placed at corresponding portions of the frame 30, and projection pieces 43C, 43D, which are formed on the end portions 43G of the fixing cover 43, are engagedly inserted into slits 43H and 43J formed in the frame 30, respectively. Recess portions at the tips of projection pieces 43A, 43B, which are formed in the vicinity of the rear side of the fixing cover 43, are placed on the ribs 59A, 59B, which are formed at the corresponding portions of the frame 30. In this state, the bearing holes 38A, 38B of the right and left side walls of the frame and the receptors 58 of the fixing cover 43 are substantially aligned with each other, the displacement members (32A), 32B are located at both the right and left ends of the fixing cover 43, and the through holes 31A, 31B at the upper ends of the displacement members (32A), 32B are disposed to extend above the upper surface of the fixing cover 43. One end portion of the cam shaft 35 at which the release lever 39 is not provided is successively penetrated through the bearing hole 38B of the corresponding side wall of the frame, the through hole 31B of the one displacement member 32B, the receptors 53 of the fixing cover 43, the through hole 31A of the other displacement member (32A) and the bearing hole 38A of the other side wall of the frame. With this arrangement, the press roller unit 32~34 is fixed in a state where the heat roller 17 is pushed against the frame 30 side. The press roller unit 32~34 is further fixed while pushed against the frame 30 from the upper side by the cam shaft 35 between the projection pieces 43C, 43D and the projection pieces 43A, 43B at the front and rear sides of the fixing cover 43. If the through holes 31A, 31B of the displacement members (32A), 32B and the bearing holes 38A, 38B of the frames 30A, 30B are not aligned with one another during the above fixing, these holes are arranged on a straight line while the displacement members (32A), 32B are pushed in against the urging force of the compression springs (34A), 34B, and the cam shaft 35 is inserted.

As described above, no fixing parts such as screws, rivets, etc. are required for the manufacture of the fixing unit 19, and the manufacture is performed by successively placing the heat roller 17, the press roller unit 32~34 and the fixing cover 43 on the frame 30 and then finally passing the cam shaft 35 through the holes from the lateral direction. Therefore, the manufacture of the fixing unit 19 is simple.

The fabricated fixing unit 19 is secured to the printer body by inserting screws into tapped holes 43E, 43F formed at both ends of the cover 43 and tapped holes formed on the frame 30 to face the tapped holes 43E, 43F. With this operation, the fixation of the fixing unit to the print body is completed.

On the lower surface of the sheet insertion port 50 of the fixing cover 43 are provided a plurality of sheet guide ribs 44 substantially parallel to the sheet feeding direction and reinforcing walls 60 that link the end portions of the ribs 44 at the press roller side to one another. If the lower ends of the walls 60 extend to the same height as the lower ends of the ribs 44, toner that is slightly attached to the back side of the sheet is attached and deposited at the ridge of the lower ends of the walls 60. The deposited toner taints the back surface of the sheet. In the embodiment shown in FIG. 6, the lower ends of the walls 60 do not extend below the ribs 44, so that the back surface of the sheet is not scraped by the ridge of the walls 60. With this construction, the above disadvantage can be overcome.

Figure 7:
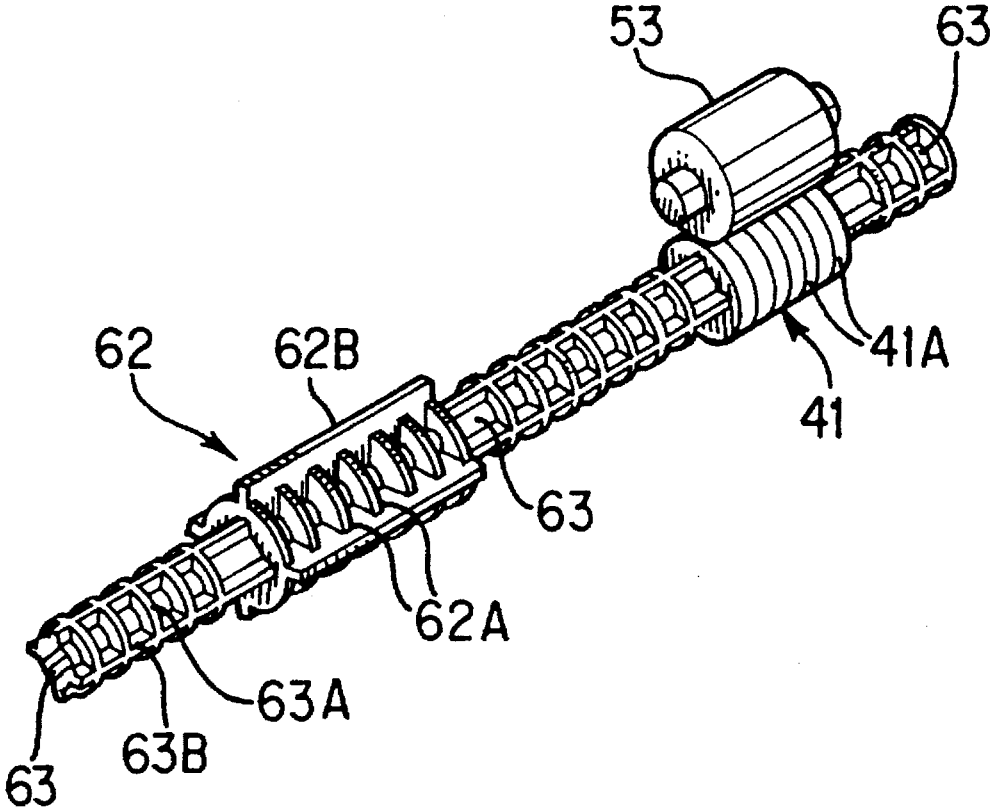
FIG. 7 is an enlarged perspective view showing a feeding roller portion.
Figure 8:
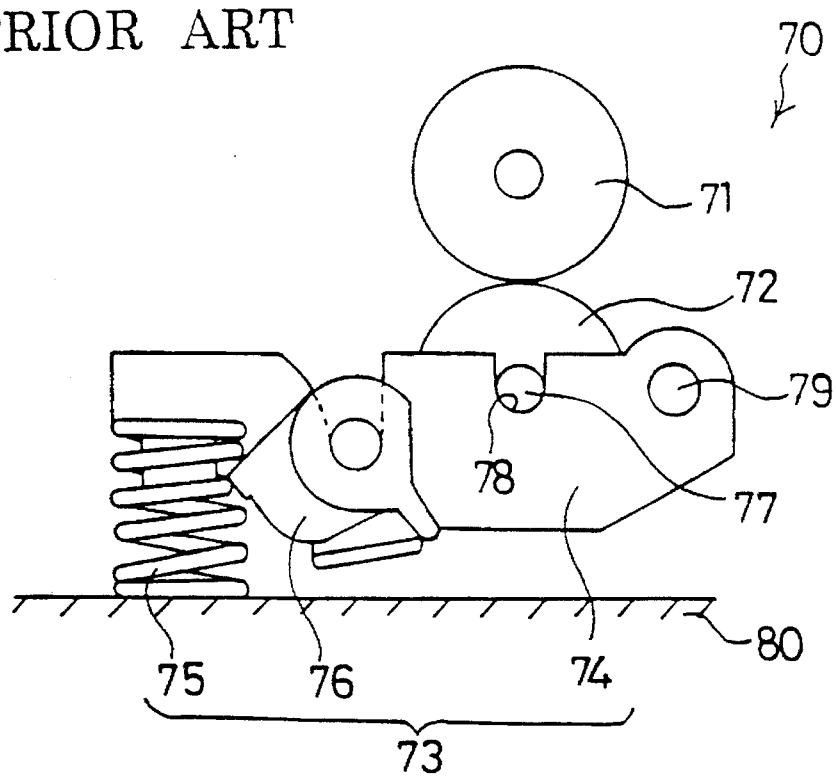
Fig.8 PRIOR ART
FIG. 8 is a side view showing a conventional fixing device in a state where a press roller is pressed against the heat roller.
Figure 9:
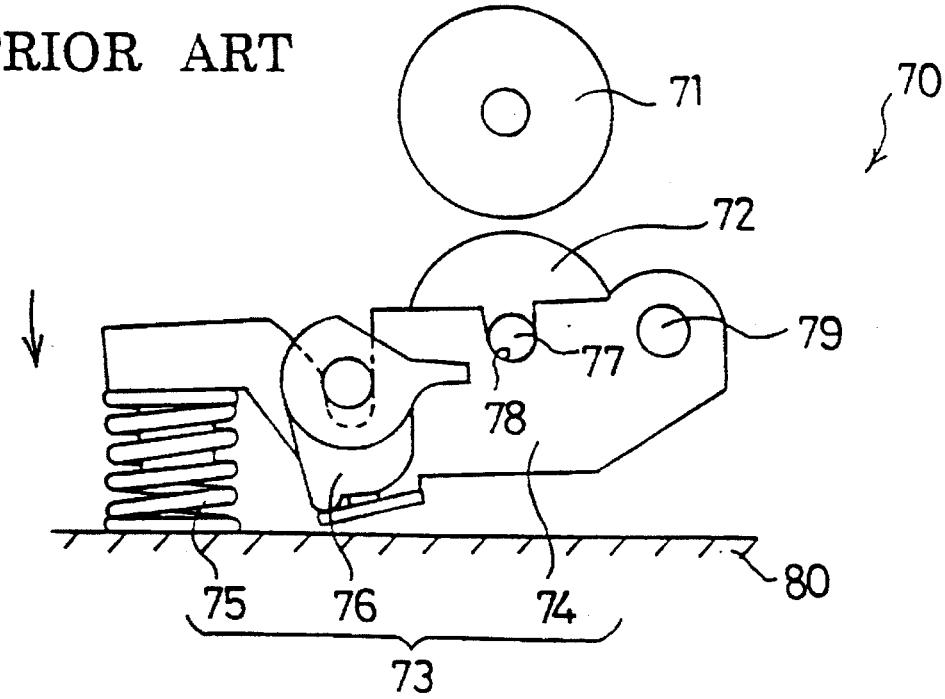
Fig.9 PRIOR ART
FIG. 9 is a side view showing the conventional fixing device in a state where the press force of the press roller is released.

FIG. 7 shows the detailed construction of the feeding roller 41 and its surrounding portion. The feeding roller 41 comprises a plurality of discs 41A that are arranged in an axial direction. Another roller portion 62 is formed on the same axis as the feeding roller 41. The roller portion 62 comprises a plurality of discs 62A that are arranged in an axial direction, and the plural discs 62A are mutually linked to one another by plural (for example, four) ribs 62B, which are designed to radially project outside of the discs 62A. Plural discs 63A and ribs 63 extending in the axial direction are formed on the periphery of the shaft portion 63, which supports the rollers 41 and 62. The rollers 41 and 62 and the shaft portion 63 are preferably integrally formed of synthetic resin material together with the gear 42. The ribs 62B of the roller portion 62 function to push out the trailing edge of the sheet in a discharge direction.

In this embodiment, the compression spring (34A), 34B is beforehand inserted into the gap between the bearing portion (33A), 33B and the displacement member (32A), 32B while being compressed, and thus, a pre-load is applied to the press roller 18. Therefore, a compression spring having a large spring constant is not required to obtain a predetermined press force with a short stroke, and a compression spring having a small spring constant may be used.

Next, the operation of the fixing unit 19 will be described with reference to FIGS. 3 and 4.

A pin 39A, which is attached to the free end of the release lever 39, is linked to the sheet guide 6 through a link member (not shown). When the sheet guide 6 is opened to remedy a sheet jam, the release lever 39 is rotated to release the urging force of the compression springs (34A), 34B, which acts on the press roller 18. The operation will be described in more detailed below.

The semicircular cam portions 35A, 35B, which are formed on the cam shaft 35, move the displacement members (32A), 32B upwardly and downwardly through the rotation of the cam shaft 35. When the cut-out (notched) faces of the cam portions 35A, 35B are placed down as shown in FIG. 4, the displacement members (32A), 32B are upwardly moved with the urging force of the compression springs (34A), 34B in such a direction that the lower edge portions of the through holes 31A, 31B are moved to the cut-out faces of the cam portions 35A, 35B, whereby the stopper members (55C), 55D at the lower ends of the grooves 55A, 55B abut against the shaft ends (18A), 18B of the press roller. With this operation, the urging force of the compression springs (34A), 34B is received by the upper ends of the grooves (54A), 54B and the lower ends (55C), 55D of the grooves 55A, 55B, and thus, no urging force acts on the press roller 18. The press roller 18 is brought into contact with the heat roller 17 only by its weight, and thus, a jammed sheet can be removed by drawing it out slightly.

Figure 3:
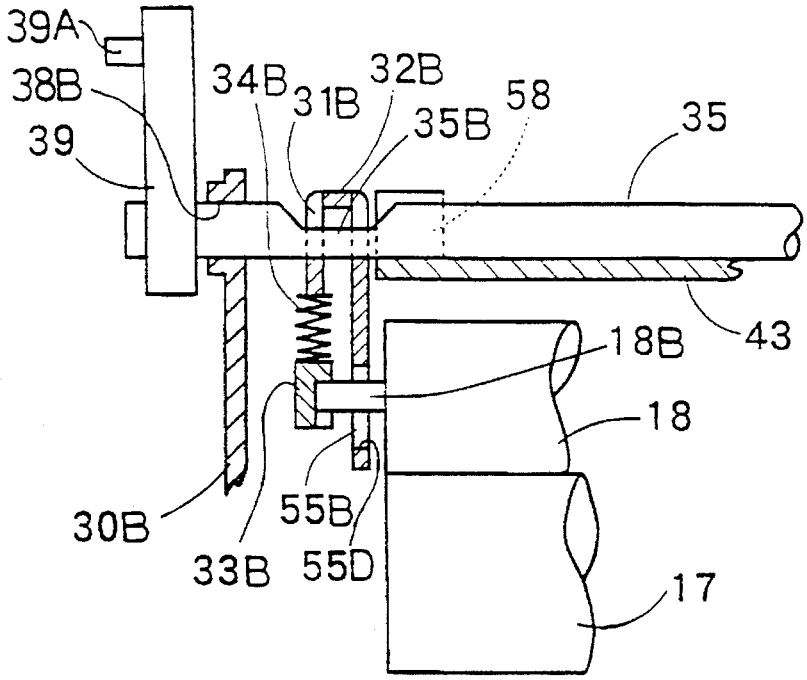
FIG. 3 is a cross-sectional view showing a state where a press roller is pressed against a heat roller.
Figure 4:
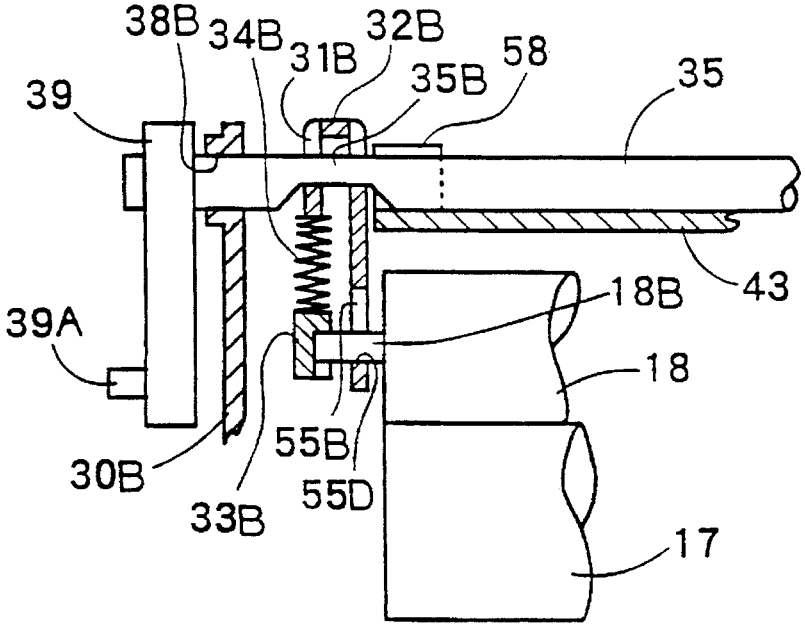
FIG. 4 is a cross-sectional view showing a state where the press force of the press roller is released.

When upon rotation of the cam shaft 35, the lower edge portions of the through holes 31A, 31B are pushed down by the outer peripheral cylindrical surfaces of the cam portions 35A, 35B, the displacement members (32A), 32B are downwardly moved as shown in FIG. 3, so that the lower ends (55C), 55D of the grooves 55A, 55B are separated from the shaft ends (18A), 18B of the press roller. The bearing portions (33A), 33B are substantially stopped irrespective of the descendance of the displacement members (32A), 32B because the press roller 18 abuts against the heat roller 17. That is, the bearing portions (33A), 33B are moved in the opposite direction relative to the displacement members (32A), 32B, so that the urging force of the compression springs (34A), 34B in the press direction is intensified. As a result, the press roller 18 is pressed against the heat roller 17 by the urging force of the compression springs (34A), 34B, and silicon rubber of the press roller 18 is compressed and deformed. In this state, an initial fixing operation with heat and pressure is performed. The bearing portions (33A), 33B are also moved in the opposite direction relative to the displacement members (32A), 32B when the displacement members (32A), 32B are upwardly moved, and in this case, the urging force of the compression springs (34A), 34B is weakened.

In FIGS. 3 and 5, the cam faces 35A, 35B of the cam shaft 35 are illustrated as being perfectly put up. However, the cam shaft 35 is not required to be rotated from the state shown in FIG. 4 by 180 degrees, and it may be rotated to such an extent that the outer peripheral cylindrical surfaces of the cam faces 35A, 35B abut against the lower ends of the through holes 31A, 31B.

What is claimed is:

1. A fixing device comprising:

a frame;

a heat roller rotatably mounted to said frame;

a press roller rotatably mounted to said frame; and a press mechanism that presses said press roller against said heat roller, said press mechanism comprising:

a displacement member displaceable in a press direction, a bearing portion movable in an opposite direction relative to said displacement member, said bearing portion supporting said press roller at a shaft portion thereof, an urging member urging said bearing portion in the press direction, and a displacing device for displacing said displacement member between a first position corresponding to a non-press position and a second position corresponding to a press position, the urging force of said urging member in the press direction being reinforced by said bearing portion, which is displaced in an opposite direction relative to said displacement member when said displacement member is displaced from the first position to the second position.

2. The fixing device as claimed in claim 1, wherein said displacing device engages said displacement member and is secured to a reception portion formed on said frame in a direction substantially perpendicular to the urging direction of said urging member.

3. The fixing device as claimed in claim 2, wherein said displacing device is rotatably mounted to said frame and comprises a cam face, said cam face displacing said displacement member between the first position and the second position through rotation thereof.

4. The fixing device as claimed in claim 3, wherein said displacing device comprises a cam shaft, and wherein said cam face comprises a cut out portion of said cam shaft.

5. The fixing device as claimed in claim 1, wherein said displacement member is slidably supported at a shaft end portion of said press roller in the press direction, said displacing device being disposed substantially on an extension line of the press direction of said press roller.

6. The fixing device as claimed in claim 1, wherein said urging member is interposed between said displacement member and said bearing portion.

7. The fixing device as claimed in claim 6, wherein said displacement member is slidably supported in the press direction at a shaft end portion of said press roller, said displacement member comprising a stopper member restricting a sliding motion of said displacement member in the press direction.

8. The fixing device as claimed in claim 7, wherein said displacement member further comprises a guide piece projectingly formed on said displacement member, said guide piece being engageable with a rib-shaped wall adjacent a side wall of said frame.

9. The fixing device as claimed in claim 1, wherein said displacing device comprises a cam shaft rotatably mounted to said frame and having a cam face, said cam face comprising a cut out portion of said cam shaft.

10. The fixing device as claimed in claim 1, further comprising a fixing cover including a projection piece engagedly insertable into a corresponding slit in said frame.

11. The fixing device as claimed in claim 10, wherein said fixing cover comprises a plurality of sheet guide ribs disposed substantially parallel to a sheet feeding direction, said plurality of guide ribs extending in a sheet path beyond a reinforcing wall of said fixing cover.

12. A press mechanism in a fixing device that presses a press roller against a heat roller, the press mechanism comprising:

a displacement unit operatively engaging said press roller;

an urging member urging said displacement unit in a press direction; and a rotatable cam shaft engaging said displacement unit and including a cam face integral with said cam shaft, said cam face displacing said displacement unit between a first position corresponding to a non-press position and a second position corresponding to a press position.

13. The fixing device as claimed in claim 12, wherein said displacement unit comprises a displacement member displaceable in the press direction and a bearing portion engaging said press roller at a shaft portion thereof.

14. The fixing device as claimed in claim 13, wherein said urging member is disposed between said displacement member and said bearing portion, said urging member urging said bearing portion in the press direction.

15. The fixing device as claimed in claim 14, wherein the urging force of said urging member in the press direction is reinforced by said bearing portion, which is displaced in an opposite direction relative to said displacement member when said displacement member is displaced from the first position to the second position.

16. The fixing device as claimed in claim 14, wherein said rotatable cam shaft engages said displacement member and is secured to a reception portion formed on a frame in a direction substantially perpendicular to the urging direction of said urging member.

17. The fixing device as claimed in claim 14, wherein said urging member comprises a spring, and wherein said displacement member is slidably supported in the press direction at a shaft end portion of said press roller said displacement member comprising a stopper member restricting a sliding motion of said displacement member in the press direction.

18. The fixing device as claimed in claim 13, wherein said displacement member is slidably supported at a shaft end portion of said press roller in the press direction, said rotatable cam shaft being disposed substantially on an extension line of the press direction of said press roller.

19. The fixing device as claimed in claim 18, wherein said cam face comprises a cut out portion of said cam shaft.

20. A press mechanism for pressing a press roller against a heat roller in a fixing device having a frame, the press mechanism constructed in accordance with a method comprising:

pivotally mounting the heat roller on a heat roller receiving portion;

securing a press roller unit to the frame;

attaching a fixing cover on the frame by engagedly inserting projection pieces of the fixing cover into corresponding slits in said frame; and passing a cam shaft sequentially through holes in the frame, the fixing cover, the press roller unit, the fixing cover and the frame.

* * * * *